United States Patent [19]

D'Angelo et al.

[11] 4,205,573

[45] Jun. 3, 1980

[54] METHOD AND APPARATUS FOR AUTOMATICALLY CUTTING LONG ROLLS OF MICROFOAM MATERIAL AND THE LIKE INTO SHORTER SUB-ROLLS

[75] Inventors: Joseph J. D'Angelo, Wycoff, N.J.; Lawrence S. Maccherone, Crystal Lake, Ill.

[73] Assignee: Flexible Design Packaging Machine Company, Hawthorne, N.J.

[21] Appl. No.: 966,135

[22] Filed: Dec. 4, 1978

[51] Int. Cl.[2] ..... B27B 11/10; B26D 3/00

[52] U.S. Cl. ..... 83/733; 83/56; 83/759

[58] Field of Search ..... 83/401, 733, 759, 649, 83/56

[56] References Cited

U.S. PATENT DOCUMENTS

| | | | |
|---|---|---|---|
| 1,537,344 | 5/1925 | Giles | 83/733 X |
| 1,624,662 | 4/1927 | Halvorsen | 83/759 |
| 2,321,863 | 6/1943 | Scheel | 83/759 |
| 3,446,104 | 5/1969 | Bushnell | 83/649 |

FOREIGN PATENT DOCUMENTS

| | | | |
|---|---|---|---|
| 2137094 | 1/1972 | Fed. Rep. of Germany | 83/759 |

*Primary Examiner*—Nicholas P. Godici

*Attorney, Agent, or Firm*—Parmelee, Johnson, Bollinger & Bramblett

[57] ABSTRACT

Large diameter long rolls of soft, spongy resilient material, for example, such as "microfoam" padding and packaging material which are to be cut into narrower sub-rolls are positioned in a support frame having means for restricting the rotational movement of the roll in one direction in the frame. A long knife blade and its reciprocating drive are positioned on the frame and with the knife blade being initially tangentially disposed with respect to the periphery of the roll. The reciprocating drive is positioned for reciprocally driving and incrementally advancing the knife blade inward with the knife blade rotating the roll on the push stroke of the blade while cutting and advancing inward along an arc on the pull stroke of the reciprocating drive. Cutting is stopped when the edge of the blade is at a predetermined distance from the mandrel on which the core of the roll is mounted in order to protect the knife blade, and the core is then cut with a hand blade so that the sub-roll can be removed from the remainder of the roll. Neatly cut square ends are produced on the cut rolls. A convenient and effective means for restricting rotational movement of the roll in one direction is a strap anchored at one end to the frame and partially wrapped around the periphery of the roll with a weight suspended from the other end, thereby acting like a one-way clutch.

17 Claims, 6 Drawing Figures

METHOD AND APPARATUS FOR AUTOMATICALLY CUTTING LONG ROLLS OF MICROFOAM MATERIAL AND THE LIKE INTO SHORTER SUB-ROLLS

BACKGROUND OF THE INVENTION

This invention relates to a method and apparatus for automatically cutting large diameter long rolls of a soft, flexible, spongy resilient material, for example, such as "microfoam" padding and packaging material into shorter sub-rolls thereof.

Many materials used in packaging and other applications are manufactured in wide sheets or webs and are sold in rolls having a large diameter and a width corresponding to the width of the web produced in the manufacturing process. These rather large rolls of material are the most economical way of purchasing the material, which may not be available in shorter widths, or must be custom ordered from the manufacturer substantially increasing the cost of the materials. The webs which are sold in rolls may be either single-layered or multi-layered, i.e. multi-ply, sheets which are formed into a single thickness and rolled. The width of the webs are so wide, for example, such as six or eight feet wide, that the material must be cut into narrower widths for most applications.

The cutting of such rolls presents a difficult problem with respect to the sheer size of the rolls, for example, five feet in diameter and six or eight feet long, as well as the characteristics of the material which is soft, pliable, flexible, spongy, resilient and particularly difficult to cut because of such properties.

One way of providing a cut in such a roll is to use a large band saw. In order to successfully use a band saw, the exposed cutting length of the blade of the band saw would be required to be as long as the diameter of the roll to be cut. Using a band saw with five feet of exposed and unsupported moving blade is quite dangerous and difficult. Moreover, the action provided by the band saw with such a long length of exposed blade produces a wavey, scalloped cut which leaves ragged and wavey edges on the ends of the roll which are cut and tends to spall off flakes or balls of loosened material on the cut ends of the roll. The wavey edges having loose material thereon waste the material, provide an unsightly appearance, and in some cases make the material as cut unsuitable for the application for which it was intended. A large exposed band saw blade provides a tremendous safety hazard and requires great care in the handling of the material and in performing the cutting function.

Other methods such as hand cutting are time consuming, labor intensive, produce unequal cuts, jagged edges and are therefore undesirable as well as uneconomical. Ordering the rolls from the manufacturer in shorter widths is prohibitably expensive, particularly when different widths for different applications are required.

Accordingly, it is an object of this invention to provide a new and novel method and apparatus for economically cutting large rolls of soft, flexible, spongy resilient material, such as microfoam material into narrower, i.e. shorter length, rolls having the same outer diameter as the initial large rolls.

Another object of this invention is to provide a novel method and apparatus for automatically dividing large rolls of soft, spongy, layered materials into narrower rolls with relatively neat, square-cut ends on the cut roll.

Still a further object of the present invention is to provide a new apparatus for automatically dividing large rolls of wide web material difficult to cut into narrower rolls and which is safe, convenient and simple in operation.

SUMMARY OF THE ILLUSTRATIVE EMBODIMENT

In attaining these and other objects and advantages and in carrying out this invention in one illustrative embodiment thereof a long roll of soft, flexible, spongy resilient material, for example, such as microfoam material which is to be divided in shorter sub-rolls is mounted in a frame. A long knife blade initially tangentially disposed with respect to the outer diameter of the roll is positioned on the frame and has drive means coupled thereto. A one-way clutch-like holding means is provided for restricting the rotational movement of the roll in a first direction while permitting rotational movement in a second direction. The drive means reciprocates the knife blade longitudinally back and forth and also moves the blade through the roll from the outer diameter inward. The drive means incrementally advances the cutting means inward along an arc as the roll is being cut. The roll is rotated during a first longitudinal motion of the cutting blade and is cut while the holding means restrains the roll during the opposite longitudinal motion of the cutting blade, preferably being rotated during the push stroke of the cutting blade and being cut during the pull stroke.

BRIEF DESCRIPTION OF THE DRAWINGS

The various features, aspects and advantages of the present invention will become more fully understood from a consideration of the following detailed description in conjunction with the accompanying drawings, in which.

DESCRIPTION OF THE PREFERRED EMBODIMENT

Figure 1:
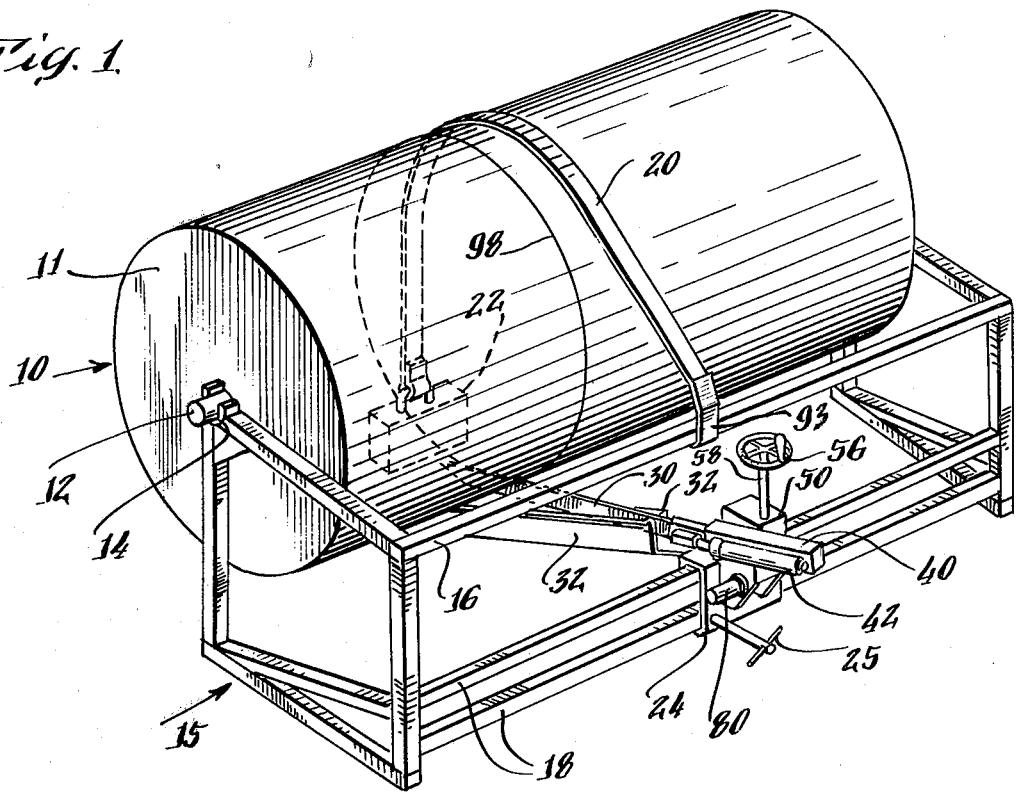
FIG. 1 is a perspective view of an illustrative embodiment of this invention, which is the preferred mode of practicing this invention.

Referring now to FIG. 1, a long roll of soft, flexible, spongy resilient material 10, for example, such as microfoam padding or packaging material, has its core positioned on a mandrel 12 and held in a cradle 14 of a support frame generally referred to with reference numeral 15. The roll 10 is comprised of a web of the soft, flexible, spongy resilient material 11 which may have a single layer, or a multiple layer or multi-ply formed together, to make up the web which is rolled up. The roll may be of different diameters and lengths, and the only requirement of the present invention is that the roll of material is desired to be cut into narrower rolls (sub-rolls) having the same outer diameter as the initial longer roll.

This type of material which is desired to be cut as well as the large diameter of the roll produces difficulties in providing a clean, straight cut without leaving ragged and wavey ends on the roll where it is cut. A straight, neat cut is accomplished by the present invention providing a sub-roll having a neat end cut square (perpendicular) to the roll axis. Merely by the way of example, one standard size microfoam roll which is desired to be cut into shorter sub-rolls is five feet in diameter and eight feet long. It will be apparent that widths of eight feet of microfoam material would have limited application, and accordingly must be cut into narrower widths for most applications, such as packaging. The overall length of the support frame 15 accommodates the length of the roll 10 which is desired to be cut.

Figure 2:
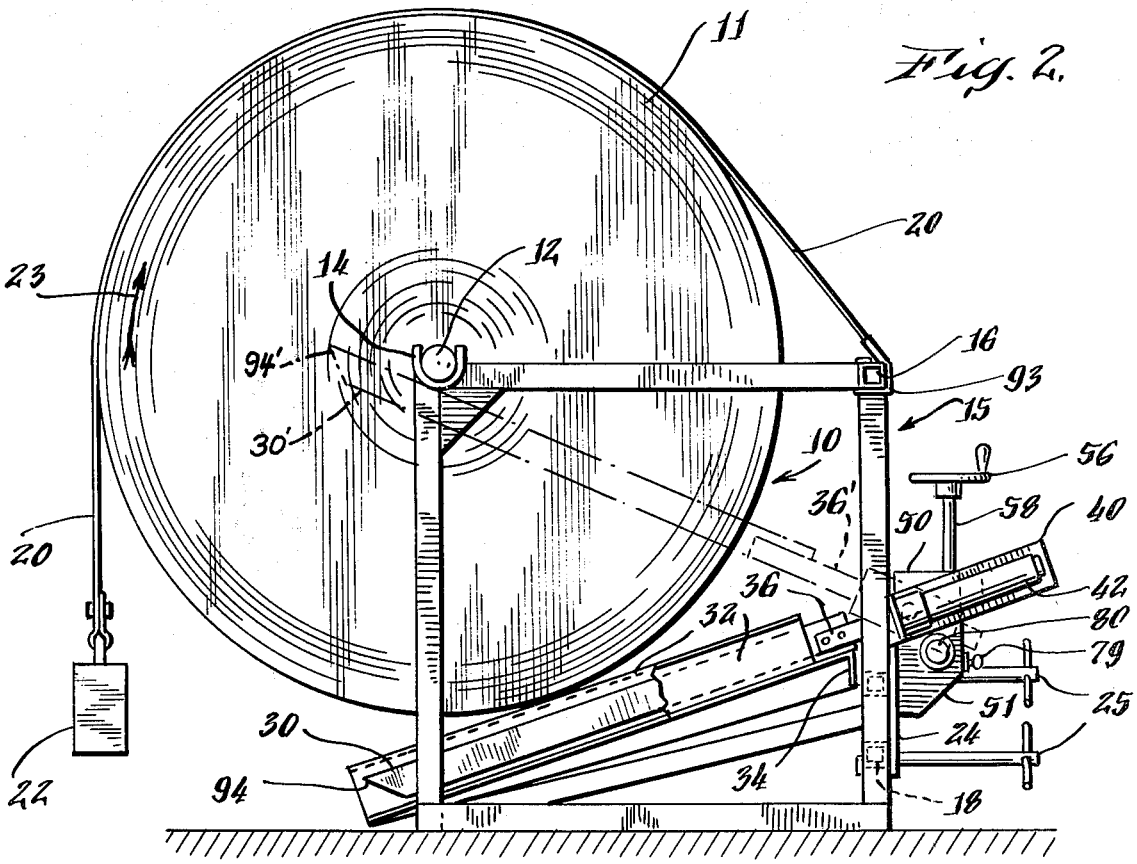
FIG. 2 is a side elevational view of FIG. 1, shown enlarged.

The frame 15 has an upper front frame member 16 to which is attached one end of a belt or strap 20 of heavy canvas or other suitable flexible material from which a weight 22 is suspended. The belt 20 has a relatively high coefficient of friction with the outside of the roll and is disposed over the roll 10 with the weight 22 being suspended from the other end of the belt 20. The belt 20, which is wrapped partially around the roll 10 as seen in FIG. 2, and the weight 22 advantageously act as a one-way clutch to restrict rotation of the roll in the direction toward the weight by virtue of the fact that such rotation serves to tighten the belt 20. However, the roll 10 is free to rotate in a direction away from the weight, i.e. clockwise as seen in FIG. 2, as shown by the arrow 23, because the frictional grip of the belt 20 becomes loosened thereby. The belt 20 and weight 22 thus act as a one-way clutch which friction works to advantage in the cutting action which will be explained hereinafter.

Figures 5, 6:
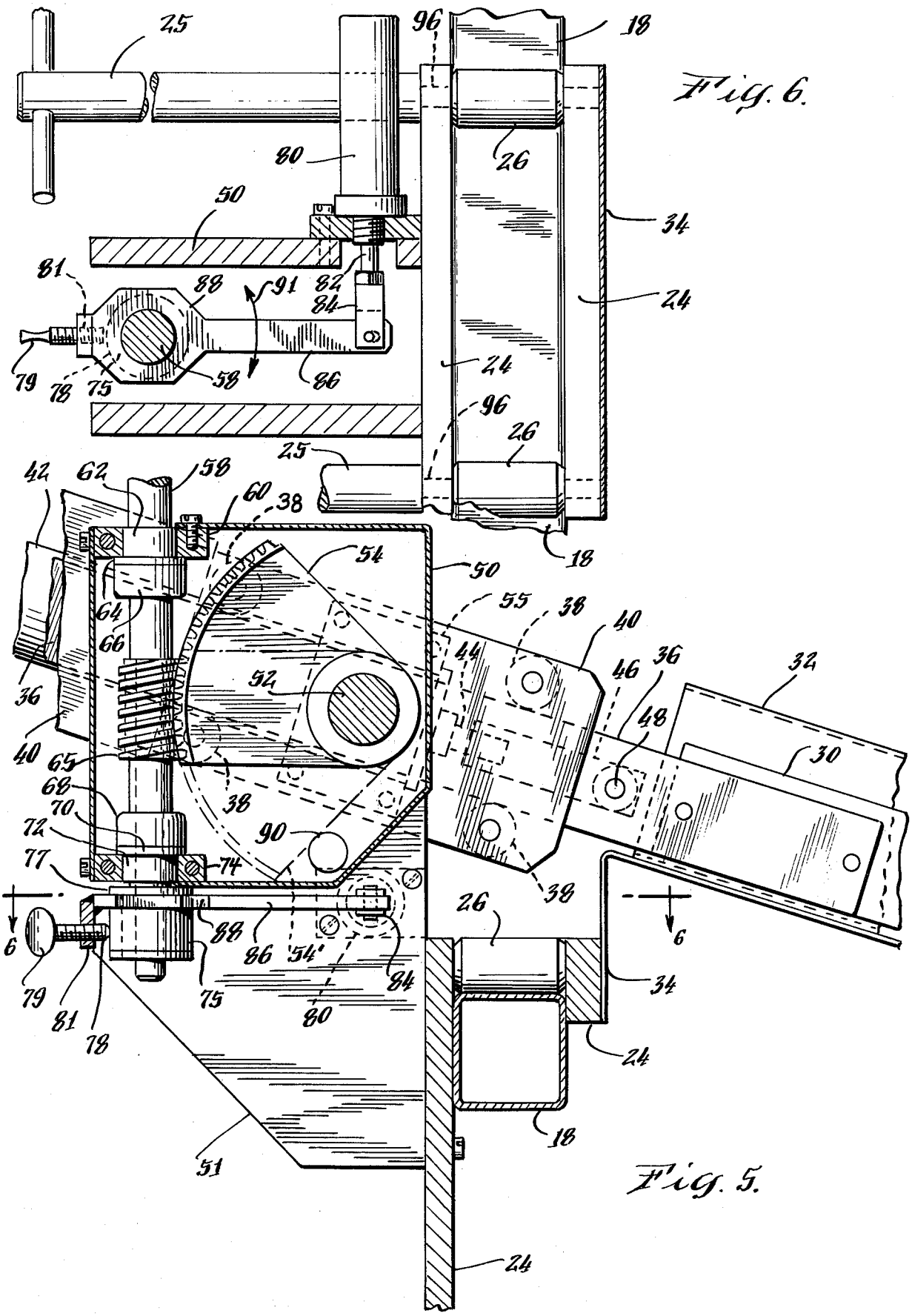
FIG. 5 is a cross-sectional elevational view taken along line 5—5 of FIG. 3.
FIG. 6 is a cross-sectional elevational view taken along line 6—6 of FIG. 5.

The frame 15 also has two lower parallel front frame members or rails 18 which form a track for carrying a movable, clampable carriage 24 which may be tightened or loosened by hand screws 25. The clampable carriage 24 is movable along the rails 18 on rollers 26 as is best shown in FIG. 6.

The carriage 24 has attached thereto a mounting bracket 34 (see FIG. 5) of a trough sheath 32 in which is nested a cutting means 30 in the form of a long, rigid knife blade which preferably contains a razor-sharp straight knife edge. The trough sheath 32 provides a protective shield for the knife 30 when the knife blade is inactive as shown in FIG. 5. The inactive knife blade 30 is housed in the trough sheath 32 to protect the cutting edge and to prevent injury to workers in mounting the roll 10 in the frame 15. The knife 30 nests in the trough sheath 32 before the cutting function begins, and the knife 30 is returned thereto at the conclusion of a cutting operation.

The carriage 24 also carries a housing 50 which is secured thereto by a pair of gussets 51. The housing 50 contains part of the drive means for the knife 30 which will be explained hereinafter. A chassis 40 is also mounted on the housing 50 and a main drive cylinder 42 which is linked to the knife blade 30. This arrangement of the carriage 24 enables the knife 30 as well as its drive means to be movable along the rails 18 to any desired location in order to position the knife 30 along the roll 10, so that the roll 10 may be cut where desired. Once the knife is positioned, the hand screws 25 are tightened to secure the clampable carriage and the drive mechanism for the knife 30 in a cutting position.

In order to perform the cutting function, the knife 30 is provided with a suitable drive means which includes a main drive cylinder 42 which through associated linkages reciprocates the knife blade 30 longitudinally to and fro. There is a secondary drive cylinder 80 which through its associated linkage swings the free end of the knife 30 inwardly toward the roll axis in small increments. Although air cylinders are preferred for the main and secondary drive cylinders 42 and 80, respectively, because of the ready availability of an air suppy in most facilities and other safety considerations which are obtained by using air instead of flammable hydraulic fluids or electrical means, it will be appreciated that any suitable drive means may be employed which imparts the type of motion required for performing the cutting function.

Figure 4:
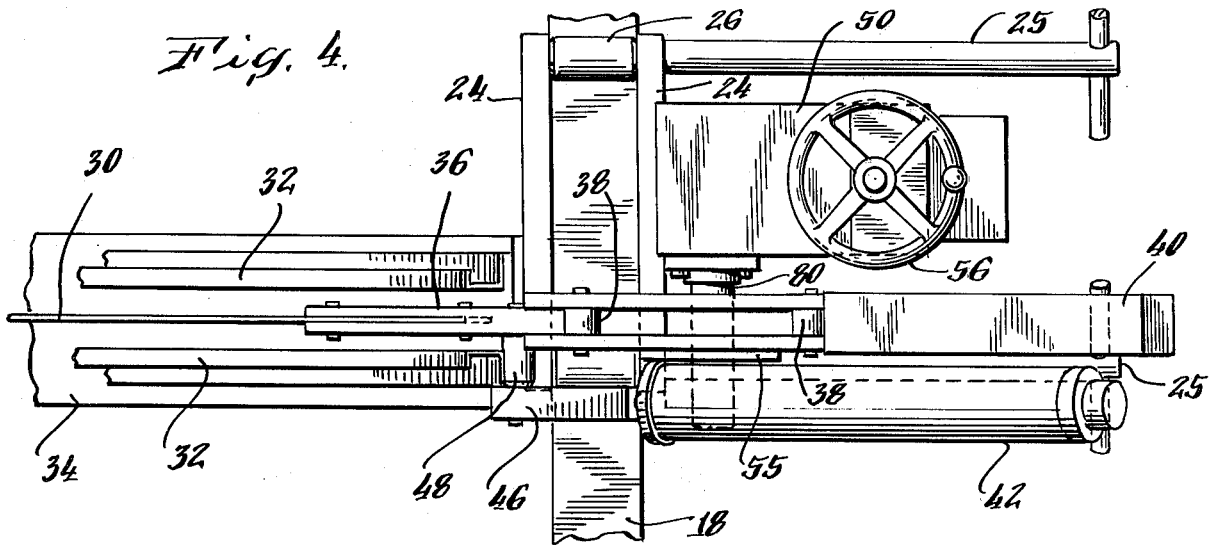
FIG. 4 is a top view of FIG. 3, shown on a somewhat small scale than FIG. 3.
Figure 3:
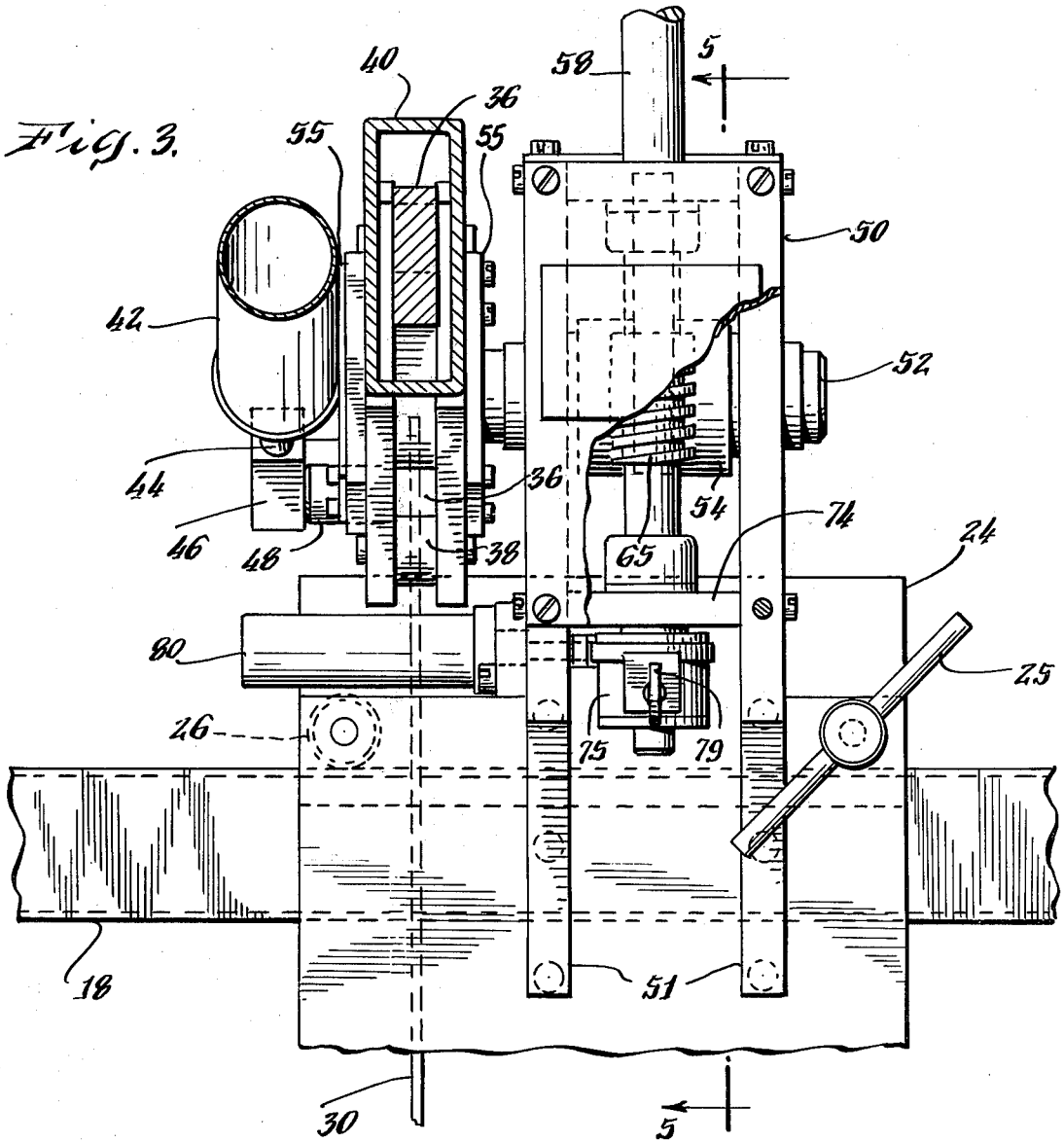
FIG. 3 is a partial front view, shown further enlarged, with some parts in section and others partly broken away, illustrating one form of drive means which may be employed in the present invention.

As will best be seen in FIGS. 3, 4 and 5, the primary drive cylinder 42 has a piston rod 44 which drives a link 46 attached by a strong pivot pin 48 to a movable bar 36 which drives the knife 30. As will best be seen in FIG. 5, the chassis 40 includes four rollers 38 therein which support the bar 36, and accordingly this bar 36 can roll longitudinally back and forth in the chassis 40 on its rollers 38, thereby reciprocating the knife 30 which is attached thereto back and forth at the command of the main drive cylinder 42. As seen in FIG. 3, the chassis 40 has the shape of a thick-walled rectangular tube, with the knife bar 36 extending through this tube and extending out of each end of the tubular chassis 40.

As will be seen in FIG. 6, the secondary drive cylinder 80 has a piston rod 82 which is secured to a clevis 84 driving an arm 86 having a hexagonal head 88. The head 88 is swingably mounted on an upright shaft 58 carrying a one-way clutch 75, and an overload clutch 78 which is set by thumb screw 79 engaging the one-way clutch. The inner sleeve of the one-way clutch 75 is secured to the shaft 58, and the outer sleeve of this one-way clutch is engaged by the thumb screw 79 which is threaded through a socket 81 in an L-shaped portion of the arm 86. Thus, swinging movement of the arm 86 as shown by the arrow 91 causes the one-way clutch to turn the shaft 58 by small increments in one direction only.

Referring now to FIG. 5, it will be seen that the shaft 58 is supported at an intermediate portion thereon by a mounting 60 secured to the top of the housing 50. The mounting 60 carries a sleeve bearing 62 and has positioned on the underside thereof a thrust bearing 64 and a collar 66 secured to the shaft 58. This shaft carries a worm gear 65 and is supported at the bottom of the housing 50 by a collar 68, a thrust bearing 70 and a mounting 74 carrying a sleeve bearing 72. A washer 77 is positioned between the lower surface of the housing 50 and the hexagonal head 88 of the arm 86.

A sector gear 54 (FIG. 5) is mounted on a horizontal shaft 52 which is secured to an attachment plate 55 attached to the chassis 40 containing the bar 36 which drives the knife 30. The horizontal axis of the shaft 52 is parallel with the axis of the roll 10. A stop 90 is positioned below the sector gear 54 and prevents further movement of the sector gear 54 when the knife blade 30 has been swung up to the top limit of its travel. The knife blade 30 swings in a plane perpendicular to the axis of the roll 10. As will be seen in FIGS. 1 and 2, the upper end of the shaft 58 carries a crank wheel 56.

As stated previously, the function of the secondary drive cylinder 80 and its associated parts forming part of the drive means is to swing the knife 30 upward in small increments. This incremental upward movement is accomplished by the secondary drive cylinder 80 whose piston rod 82 swings the arm 86 to and fro. The one-way clutch 75 positioned on the shaft 58 causes the shaft 58 to rotate only in one direction in small increments thereby stepping the sector gear 54 downward in small increments and turning the chassis 40 in like increments upward, i.e. turning the chassis 40 counterclockwise as seen in FIG. 5 in very small steps. Since the chassis carries the bar 36 which is attached to the knife 30, the knife 30 is swung upward in small increments until the sector gear 54 hits the stop 90.

The knife 30 is illustrated in FIG. 1 at 30' in dashed outline in its fully elevated position. The overload clutch 78 in the intermittent drive of the worm gear shaft 58 allows the knife 30 to stop advancing upwardly, when the end of the sector gear 54 engages the stop 90. In this way, the knife 30 is prevented from reaching the mandrel 12 on which the core of the roll 10 is mounted, thereby preventing damage of the knife.

The method of operation of this embodiment of the invention comprises first, placing a roll 10 which is to be cut on a mandrel 12 and mounting the mandrel in the cradle 14 of the frame 15. The hand screws of the clampable carriage 24 are loosened and the carriage 24 is moved along the rails 18 to place the knife 30 in position along the roll where the cut is desired to be made. The hand screws 25 are then tightened. As seen in FIG. 6, the hand screws 25 are on the front ends of the studs 96 which serve as shafts for the carriage rollers 26. Thus, when the hand screws 25 are tightened they draw the front and rear portions 24 of the carriage toward each other for clamping onto the frame track 18. After the carriage 24 is clamped in position on the track 18, the belt 20 is attached by a hook 93 to the upper front frame 16 and placed over the roll 10 with the weight 22 suspended therefrom. The thumb screw 79 is loosened, and the hand wheel 56 is turned until the knife blade 30 has been swung up into the tangential relationship with respect to the periphery of the roll 10, and the thumb screw 79 is then tightened.

The drive means is then operated with the main drive cylinder 42 reciprocating the knife blade 30 from one end thereof with the other end being free to swing up in contacting the roll. As the knife blade 30 is reciprocated, it turns the roll 10 slightly during its push or extension stroke due to the action of the restraining belt 20 which becomes loosened during the push stroke. The blade 30 cuts the roll 10 on the pull or retraction stroke while the roll 10 is held stationary by the friction grip of the partially encircling belt 20 which is tightened during such a stroke. The action of the secondary drive cylinder 80 turns the worm gear 65 and its associated sector gear 54 advancing the knife 30 progressively in an incremental swinging movement inward toward the roll axis during each cutting stroke.

Accordingly, the roll 10 is progressively cut, and the cut progressively extends incrementally step-by-step completely around the roll and incrementally step-by-step inwardly to produce a clean cut 98 in a plane which is perpendicular to the roll axis. For example, the knife blade 30 reciprocates longitudinally in a predetermined stroke approximately six inches long. The periphery of the roll becomes turned a distance, for example, of approximately five to six inches or so during the extension stroke of the knife as a result of frictional grip between the moving knife blade and the roll material 11. There may be some slippage between the blade and the roll. Then, during the cutting (retraction) stroke of the knife, the free end 94 of the knife blade is swung up by a small increment of approximately 1/16th to ¼th of an inch. The knife blade is swinging in a plane which is perpendicular to the axis of the roll. The resultant cut 98 as shown in FIG. 1 progressively extends completely around the roll in a plane perpendicular to the roll axis and progressively extends inwardly toward the roll axis, producing a neat square cut end surface on the cut rolls.

The knife blade 30 can be reciprocated longitudinally back and forth at any reasonable rate as may be desired, for example, in the range from a few cycles per minute up to forty or more cycles per minute depending upon the roll size and material being cut. The secondary drive cylinder 80 is arranged to have a cycle time which is the same as the cycle time of the primary drive cylinder 42, and its cycles of operation are synchronized with those of the primary drive cylinder. The overall length of the knife blade is equal to the radius of the roll to be cut plus approximately twice the length of the stroke. For example, for cutting rolls five feet in diameter, the knife blade as shown was made of a strip of tough high strength steel 3/16th of an inch thick, three inches wide and 41 inches long, sharpened by grinding along both sides near the upper edge and tempered to hold its cutting edge.

When the worm-driven sector gear 54 reaches the stop 90, as shown in dashed outline at 54' in FIG. 5, the slip action of overload clutch 78 allows the knife 30 to stop advancing when it is approximately ⅛th to ¼th inch from the mandrel 12. The thumb screw of the overload clutch 78 is then loosened, and the hand crank 56 is turned to swing the knife 30 back down to its rest position in the trough sheath 32. The cardboard tube core inside the roll 10 is then cut by an elongated hand saw and the resulting sub-roll is then removed from the mandrel 12.

The aforesaid described method and apparatus provides a method and apparatus for conveniently and economically sub-dividing long rolls of material which are difficult to cut into shorter sub-rolls thereof in a simple, efficient and safe method. The cut provided is clean and square to the roll axis as contrasted with the wavey, scalloped and ragged cuts provided by such methods as using a band saw for cutting.

Since other modifications and changes varied to fit particular operating requirements and environments will be apparent to those skilled in the art, this invention is not considered limited to the examples chosen for purposes of illustration and covers all changes and modifications which do not constitute a departure from the true spirit and scope of this invention.

We claim:

1. Apparatus for automatically cutting long rolls comprised of continuous wound web of soft, flexible, spongy material into shorter-length sub-rolls thereof comprising:

(a) a frame for holding a long roll of soft, spongy material which is to be cut into sub-rolls of the same outer diameter as said long roll, (b) cutting means positioned on said frame and being initially disposed tangentially with respect to the periphery of said roll, (c) drive means including reciprocating means coupled to said cutting means for moving said cutting means through said roll from the periphery inward toward the roll axis, (d) holding means for restricting rotational movement of said roll in a first direction while permitting rotational movement in a second direction, and (e) said cutting means rotating said long roll in said second direction during reciprocating motion in a first direction and cutting said roll while said holding means holds said long roll during reciprocating motion thereof in the second direction.

2. The apparatus set forth in claim 1 wherein said drive means includes means for incrementally advancing said cutting means inward by a relatively small distance in a swinging movement toward the axis of the roll as the roll is being cut.

3. The apparatus set forth in claim 1 or claim 2 wherein said cutting means comprises a knife blade.

4. The apparatus set forth in claims 1 or 2 wherein said holding means comprises a belt attached at one end to said frame which extends over said long roll and has a weight suspended from the other end thereof.

5. The apparatus set forth in claim 2 in which said means for incrementally advancing said cutting means inward is a worm-driven sector gear attached to said cutting means.

6. The apparatus set forth in claims 2 or 5 wherein said drive means comprises a pair of pneumatic cylinders operating in time with each other, one of said cylinders reciprocating said cutting means and the other incrementally advancing said cutting means inward toward the roll axis.

7. A method of cutting a long roll of soft, flexible, spongy material into narrower sub-rolls thereof comprising the steps of:

(a) mounting a roll to be cut in a frame, (b) restricting the rotation of said roll to one direction in the frame, (c) reciprocating a knife edge in a plane perpendicular to the axis of the roll, (d) rotating said roll during a first reciprocating motion of said knife edge against said roll, (e) cutting said roll during a second reciprocating motion of said knife edge while the movement of the roll is being restricted, and (f) incrementally moving said knife edge inward toward the axis of said roll during such cutting step thereby cutting said roll progressively completely around the periphery and progressively inwardly toward the axis.

8. The method set forth in claim 7 including the step of removing said knife edge from the cut before the roll has been completely cut through its core, and cutting through the core of the roll by hand.

9. Apparatus for automatically cutting long rolls of microfoam material or the like into shorter-length sub-rolls comprising:

(a) a frame for holding a long roll of such material which is to be cut into sub-rolls thereof, (b) cutting means movably positioned on said frame whereby said cutting means may be moved along with respect to the length of a long roll to a position thereon where the long roll is to be cut, (c) holding means for restricting rotational movement of said roll in a first direction while permitting rotational movement in a second direction, (d) drive means coupled to said cutting means for reciprocating and incrementally advancing said cutting means inward as said roll is being cut, and (e) said cutting means rotating said roll in said second direction on a first reciprocating motion thereof and cutting said roll and incrementally advancing inward on a second reciprocating motion thereof while said holding means is restricting the movement of said roll.

10. The apparatus set forth in claim 9 wherein said cutting means comprises a knife blade.

11. The apparatus set forth in claim 9 wherein said holding means comprises a belt attached to said frame on one end thereof with a weight suspended from the other end thereof, said belt being draped over said roll.

12. The apparatus set forth in claim 9 wherein said drive means comprises a pair of pneumatic cylinders, first means coupling one cylinder to said cutting means for imparting reciprocating motion thereto, and second means coupling said other cylinder to said cutting means for incrementally advancing said cutting means.

13. The apparatus set forth in claim 12 wherein said second means comprises a worm-driven sector gear with said worm being driven by said other cylinder for incrementally advancing said knife blade in a swinging movement.

14. The apparatus set forth in claim 12 wherein said pneumatic cylinders are air cylinders.

15. Reciprocating knife cutting apparatus for automatically cutting large diameter long rolls of flexible, spongy material into shorter-length sub-rolls comprising:

(a) one-way clutch means adapted to be mounted on a support frame on which such a roll may be supported for permitting the roll to be rotated in only one direction about its axis, (b) carriage means adapted to be mounted on the support frame on which such a roll may be mounted, (c) a knife blade longitudinally reciprocatably mounted with respect to said carriage means and having a free end extending away from said carriage means by a distance greater than the radius of the roll to be cut, said knife blade being in a plane which is perpendicular to the roll axis, (d) reciprocating drive means on said carriage means coupled to said knife blade for reciprocating said knife blade in alternating extension and retraction strokes, (e) said knife blade also being mounted on said carriage for swinging movement of said knife blade in said plane perpendicular to the roll axis with the cutting edge of the knife blade facing toward the roll axis, (f) incremental drive means for swinging the knife blade inward a small increment toward the roll axis during predetermined alternate strokes, said predetermined alternate strokes being in the direction in which said one-way clutch means prevents said roll from rotating about its axis, (g) thereby during said predetermined alternate strokes the knife blade cuts inwardly a small increment toward the roll axis and during the intervening strokes the friction of the knife blade is permitted to rotate the roll somewhat about its axis to a new cutting position, and (h) whereby the roll is automatically cut perpendicular to its axis.

16. Reciprocating knife cutting apparatus as claimed in claim 15 for automatically cutting such rolls, in which:

(a) a chassis is mounted on said carriage means for turning movement about a second axis parallel with said roll axis, said knife blade is attached at one end to a bar, said bar is longitudinally reciprocatably mounted in said chassis, and said incremental drive means turns said chassis about said second axis in small increments during predetermined ones of said strokes for moving the knife blade inwardly toward the roll axis.

17. Reciprocating knife cutting apparatus as claimed in claim 16 for automatically cutting such rolls, in which:

(a) said incremental drive means turns said chassis about said second axis in a small increment during each retraction stroke in a direction for advancing the cutting edge of the knife inwadly toward the roll axis during such retraction stroke.

* * * * *